US012038182B2

(12) United States Patent
Yoon et al.

(10) Patent No.: US 12,038,182 B2
(45) Date of Patent: Jul. 16, 2024

(54) AIR CONDITIONER AND HOME APPLIANCE

(71) Applicant: Samsung Electronics Co., Ltd., Suwon-si (KR)

(72) Inventors: Seong Hyun Yoon, Suwon-si (KR); Jin Baek Kim, Suwon-si (KR); Yeon Je Kim, Suwon-si (KR); Eung Ryeol Seo, Suwon-si (KR); Chang-Woo Jung, Suwon-si (KR); Dong Gi Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 621 days.

(21) Appl. No.: 17/271,171

(22) PCT Filed: Mar. 15, 2019

(86) PCT No.: PCT/KR2019/002999
§ 371 (c)(1),
(2) Date: Feb. 24, 2021

(87) PCT Pub. No.: WO2020/040392
PCT Pub. Date: Feb. 27, 2020

(65) Prior Publication Data

US 2021/0396398 A1 Dec. 23, 2021

(30) Foreign Application Priority Data

Aug. 24, 2018 (KR) ..... 10-2018-0099013

(51) Int. Cl.
*F24F 1/0014* (2019.01)
*F24F 1/0033* (2019.01)
(Continued)

(52) U.S. Cl.
CPC ..... *F24F 1/0014* (2013.01); *F24F 1/0033* (2013.01); *F24F 8/10* (2021.01);
(Continued)

(58) Field of Classification Search
CPC ..... F24F 13/10; F24F 1/0014; F24F 13/20; F24F 13/12; F24F 1/0033
See application file for complete search history.

(56) References Cited

U.S. PATENT DOCUMENTS

| | | | |
|---|---|---|---|
| 8,535,010 | B2 | 9/2013 | Terao |
| 2017/0023264 | A1 | 1/2017 | Ha et al. |
| 2018/0209668 | A1 | 7/2018 | Ha et al. |

FOREIGN PATENT DOCUMENTS

| | | | |
|---|---|---|---|
| CN | 204555012 | U | 8/2015 |
| CN | 106403033 | A | 2/2017 |

(Continued)

OTHER PUBLICATIONS

Supplementary European Search Report dated Jul. 26, 2021 in connection with European Patent Application No. 19 85 2867, 8 pages.

(Continued)

*Primary Examiner* — Ana M Vazquez

(57) ABSTRACT

A home appliance includes a housing including an inlet, a first outlet formed in the housing to discharge air introduced through the inlet, a second outlet disposed adjacent to the first outlet, a fan assembly including a first fan configured to discharge air toward the first outlet, and a second fan configured to discharge air toward the second outlet, and a stator provided to guide air, which is discharged from the first fan, to the first outlet.

11 Claims, 16 Drawing Sheets

(51) Int. Cl.

| | |
|---|---|
| ***F24F 8/10*** | (2021.01) |
| ***F24F 8/80*** | (2021.01) |
| ***F24F 11/30*** | (2018.01) |
| ***F24F 13/12*** | (2006.01) |
| ***F24F 13/20*** | (2006.01) |

(52) U.S. Cl.

CPC ..... *F24F 8/80* (2021.01); *F24F 11/30* (2018.01); *F24F 13/12* (2013.01); *F24F 13/20* (2013.01); *F24F 2013/205* (2013.01)

(56) References Cited

FOREIGN PATENT DOCUMENTS

| | | | | | |
|---|---|---|---|---|---|
| CN | 107178827 | A | | 9/2017 | |
| CN | 206723128 | U | | 12/2017 | |
| CN | 107869765 | A | | 4/2018 | |
| CN | 108019825 | A | | 5/2018 | |
| CN | 109425024 | A | * | 3/2019 | |
| CN | 209053810 | U | * | 7/2019 | |
| EP | 2518418 | A1 | * | 10/2012 | ..... F24F 1/0014 |
| EP | 3040628 | A1 | | 7/2016 | |
| EP | 3379155 | A1 | | 9/2018 | |
| JP | H06-337133 | A | | 12/1994 | |
| JP | 2016-099030 | A | | 5/2016 | |
| KR | 10-1999-0002313 | A | | 1/1999 | |
| KR | 10-2005-0074140 | A | | 7/2005 | |
| KR | 10-0665999 | B1 | | 1/2007 | |
| KR | 10-2011-0018740 | A | | 2/2011 | |
| KR | 10-1385293 | B1 | | 4/2014 | |
| KR | 10-1388483 | B1 | | 4/2014 | |
| KR | 10-2016-0051095 | A | | 5/2016 | |
| KR | 10-2016-0077359 | A | | 7/2016 | |
| KR | 10-1720644 | B1 | | 3/2017 | |
| KR | 10-1791056 | B1 | | 10/2017 | |
| KR | 10-1823503 | B1 | | 1/2018 | |
| KR | 10-2018-0032439 | A | | 3/2018 | |
| KR | 10-2018-0055793 | A | | 5/2018 | |
| WO | 2017/119689 | A1 | | 7/2017 | |

OTHER PUBLICATIONS

International Search Report dated Jul. 16, 2019 in connection with International Patent Application No. PCT/KR2019/002999, 2 pages.

Office Action dated Nov. 23, 2022 in connection with Chinese Patent Application No. 201980069931.8, 14 pages.

Chinese National Intellectual Property Administration, First Office Action regarding Application No. 201980069931.8, issued Apr. 29, 2022.

Korean Intellectual Property Office, "Notice of Preliminary Rejection," issued Mar. 27, 2023, in connection with Korean Patent Application No. 10-2018-0099013, 14 pages.

China National Intellectual Property Administration, "The Third Office Action," dated Apr. 12, 2023, in connection with Chinese Patent Application No. 201980069931.8, 20 pages.

Communication under Rule 71(3) EPC dated Oct. 10, 2023, in connection with European Patent Application No. 19852867.1, 52 pages.

* cited by examiner

AIR CONDITIONER AND HOME APPLIANCE

CROSS-REFERENCE TO RELATED APPLICATIONS

This application is a 371 of International Application No. PCT/KR2019/002999 filed on Mar. 15, 2019, which claims priority to Korean Patent Application No. 10-2018-0099013 filed on Aug. 24, 2018, the disclosures of which are herein incorporated by reference in their entirety.

BACKGROUND

1. Field

The present disclosure relates to an air conditioner and a home appliance, and more particularly, to an air conditioner and a home appliance including a plurality of outlets.

2. Description of Related Art

In general, an air conditioner is a device that removes dust in the air while controlling temperature, humidity, airflow, and distribution of the air to be suitable for human activities by using a refrigeration cycle. The refrigeration cycle includes a compressor, a condenser, an evaporator, an expansion valve, and a blower unit as main components.

The air conditioner includes a heat exchanger configured to exchange heat with air introduced into a housing, and a fan configured to discharge air, which is introduced into the housing, back into the room. With the air conditioner, a user may feel cold and unpleasant when the user is in direct contact with the discharged air, and a user may feel hot and unpleasant when the user is not in contact with the discharged air.

An air purifier is a device used to remove pollutants from the air. The air purifier may remove bacteria, viruses, mold, fine dust, and chemicals that cause odors in the introduced air.

The air purifier includes a filter configured to filter air introduced into a housing, and a fan configured to discharge the air, which is introduced into the housing, back into the room. With the air purifier, a user may feel unpleasant when the user is in direct contact with the discharged air.

The present disclosure is directed to providing an air conditioner capable of providing heat-exchanged air and providing air mixed with room air by using a single fan.

Further, the present disclosure is directed to providing an air conditioner and a home appliance including an improved discharge flow path structure.

Further, the present disclosure is directed to providing an air conditioner and a home appliance including various air discharge methods.

SUMMARY

One aspect of the present disclosure provides an air conditioner including a housing including an inlet, a first outlet formed in the housing to discharge air introduced through the inlet, a second outlet disposed adjacent to the first outlet, a fan assembly including a first fan configured to discharge air toward the first outlet, and a second fan configured to discharge air toward the second outlet, a stator provided to guide air, which is discharged from the first fan, to the first outlet, and a heat exchanger configured to exchange heat with air discharged through the first outlet.

A first flow path may be formed between the first fan and the first outlet, and a second flow path partitioned from the first flow path may be formed between the second fan and the second outlet. The stator may be provided to guide air, which is discharged from the second fan, to the second outlet.

The air conditioner may further include a flow path control unit configured to selectively block the second flow path.

The air conditioner may further include a partition plate provided to allow the first flow path and the second flow path to be partitioned from each other, and the flow path control unit may be rotatably coupled to the partition plate.

The air conditioner may further include a fixing member including a first opening provided to communicate with the first flow path and a second opening provided to communicate with the second flow path, and a sliding member slidably coupled to the fixing member and configured to open and close the first opening and the second opening.

The air conditioner may further include a flow control unit configured to block the second flow path, a driving source configured to generate power for moving the flow path control unit, and a power transmission member configured to transmit the power generated from the driving source to the flow path control unit.

The fan assembly may include a fan driver configured to drive the first fan and the second fan.

The air conditioner may further include a fan control member configured to selectively interfere with a rotation of the second fan. The first fan and the second fan may be configured to be rotatable independently of each other, and the fan assembly may include a fan driver configured to rotate the first fan.

The fan assembly may include a first fan driver configured to drive the first fan, and a second fan driver configured to drive the second fan. The first fan may be provided to have the same rotation axis as the second fan, and the first fan is arranged inside the second fan.

The fan assembly may include a boundary portion disposed between the first fan and the second fan, and the boundary portion may be disposed to face the stator.

The stator may include a stator opening provided to communicate with the boundary portion, and a diameter of the stator opening may be the same as a diameter of the boundary portion.

Another aspect of the present disclosure provides a home appliance including a housing including an inlet, a first outlet formed in the housing to discharge air introduced through the inlet, a second outlet disposed adjacent to the first outlet, a fan assembly including a first fan configured to discharge air toward the first outlet, and a second fan configured to discharge air toward the second outlet, and a stator provided to guide air, which is discharged from the first fan, to the first outlet.

The home appliance may further include a filter arranged between the inlet and the fan assembly.

The home appliance may further include a heat exchanger arranged between the first fan and the first outlet.

The home appliance may further include a first plate fixed to the housing, and a second plate configured to be rotatable with respect to the first plate, and configured to selectively open and close the second outlet.

A first flow path may be formed between the first fan and the first outlet, and a second flow path partitioned from the first flow path may be formed between the second fan and the second outlet. The stator may be provided to guide air, which is discharged from the second fan, to the second outlet.

The fan assembly may include a boundary portion provided to allow the first flow path and the second flow path to be partitioned from each other. The first fan may be disposed on an inner circumferential surface of the boundary portion and the second fan may be disposed on an outer circumferential surface of the boundary portion.

The stator may include a stator opening provided to communicate with the boundary portion, and a diameter of the stator opening may be the same as a diameter of the boundary portion.

The fan assembly may include a fan driver configured to drive the first fan and the second fan.

The home appliance may further include a flow path control unit configured to selectively block the second flow path.

The air conditioner may have a variety of air discharge methods because the air conditioner includes a first outlet, in which a discharge panel including a plurality of discharge holes is provided, and a second outlet provided to discharge air, which is not heat-exchanged, at a higher speed than the first outlet.

The air conditioner and the home appliance may have a variety of air discharge methods by using a single fan because the air conditioner and the home appliance include a stator provided to distribute air that is discharged from the single fan.

DETAILED DESCRIPTION

Figure 1:
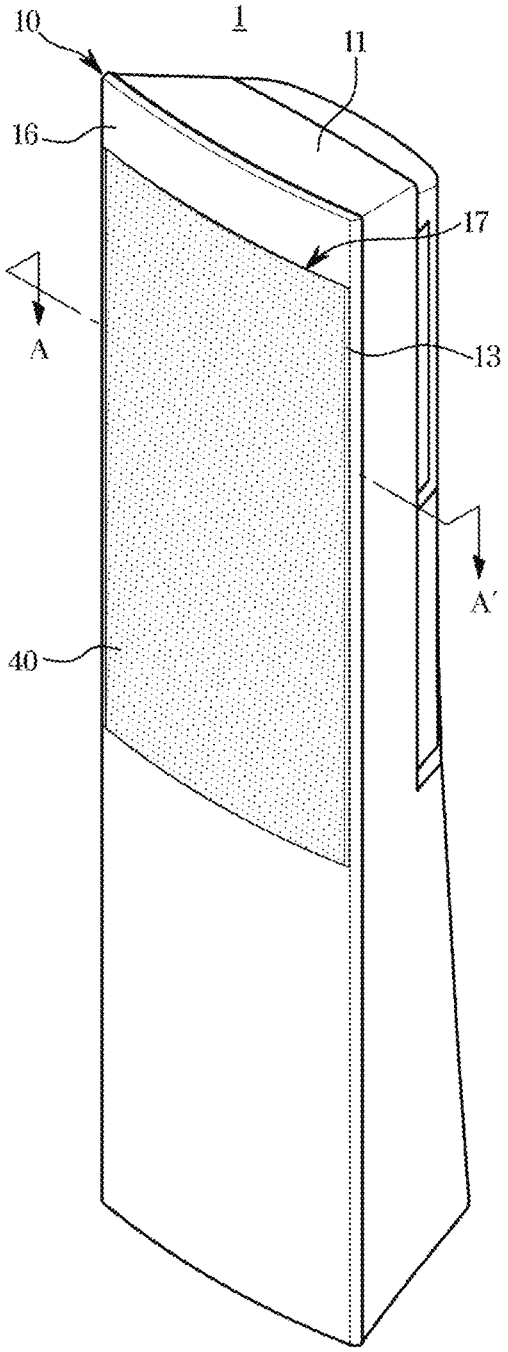
FIG. 1 is a view of an air conditioner according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

Parts which are not associated with the description are omitted in order to particularly describe the disclosure, and like reference numerals refer to like elements throughout the specification.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side", and the like may be defined by the drawings, but the shape and the location of the component is not limited by the term.

Hereinafter for convenience of description, an air conditioner is described as an example, but a configuration, to which a plurality of discharge flow paths according to one embodiment of the present disclosure is applicable, is not limited to the air conditioner. Therefore, the configuration may be applicable to any home appliance that may include a plurality of discharge flow paths, for example, such as an air purifier, a humidifier, or a dehumidifier.

Hereinafter exemplary embodiments of the present disclosure will be described in detail with reference to the accompanying drawings.

Figure 2:
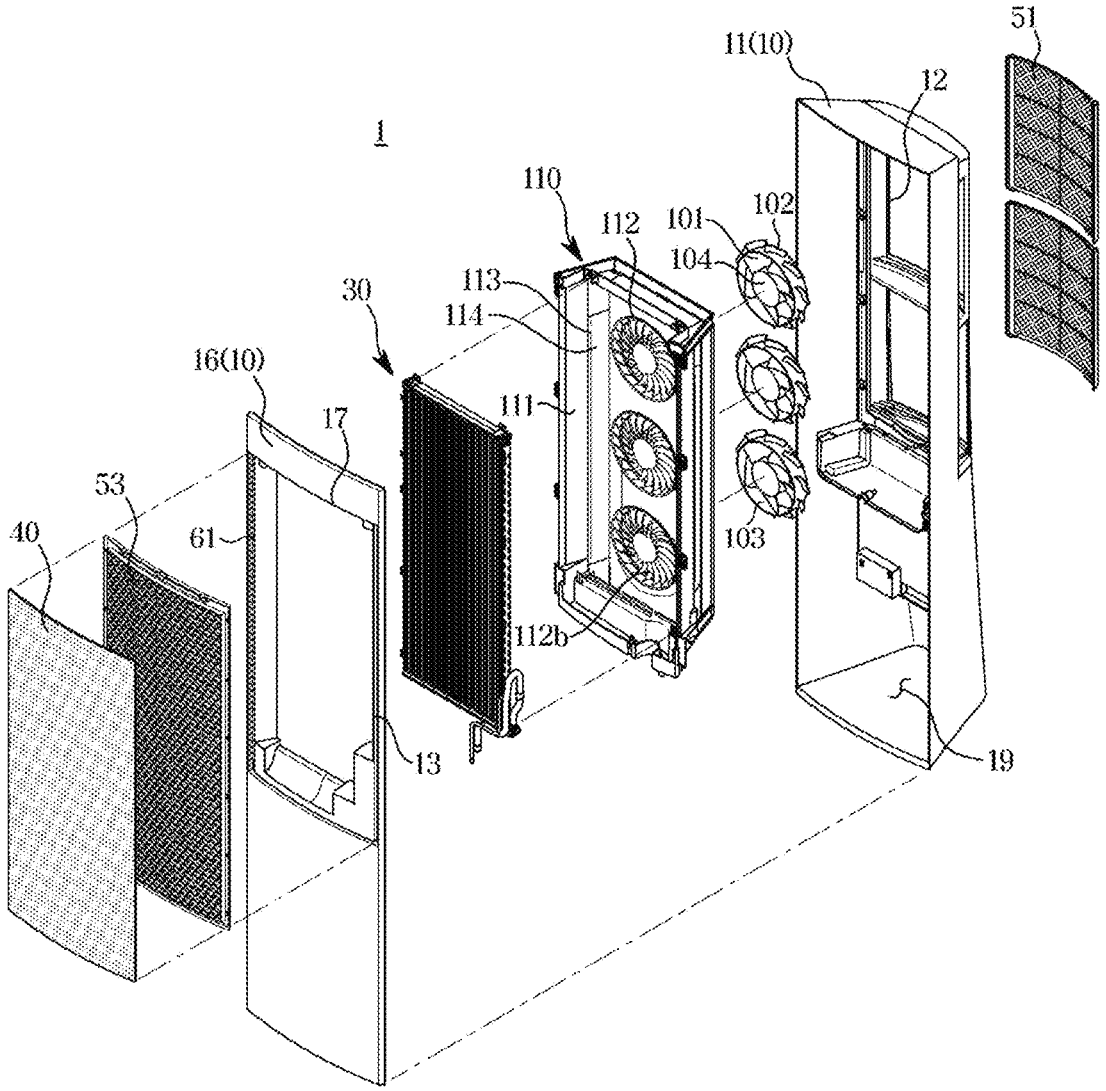
FIG. 2 is an exploded view of the air conditioner shown in FIG. 1.
Figure 3:
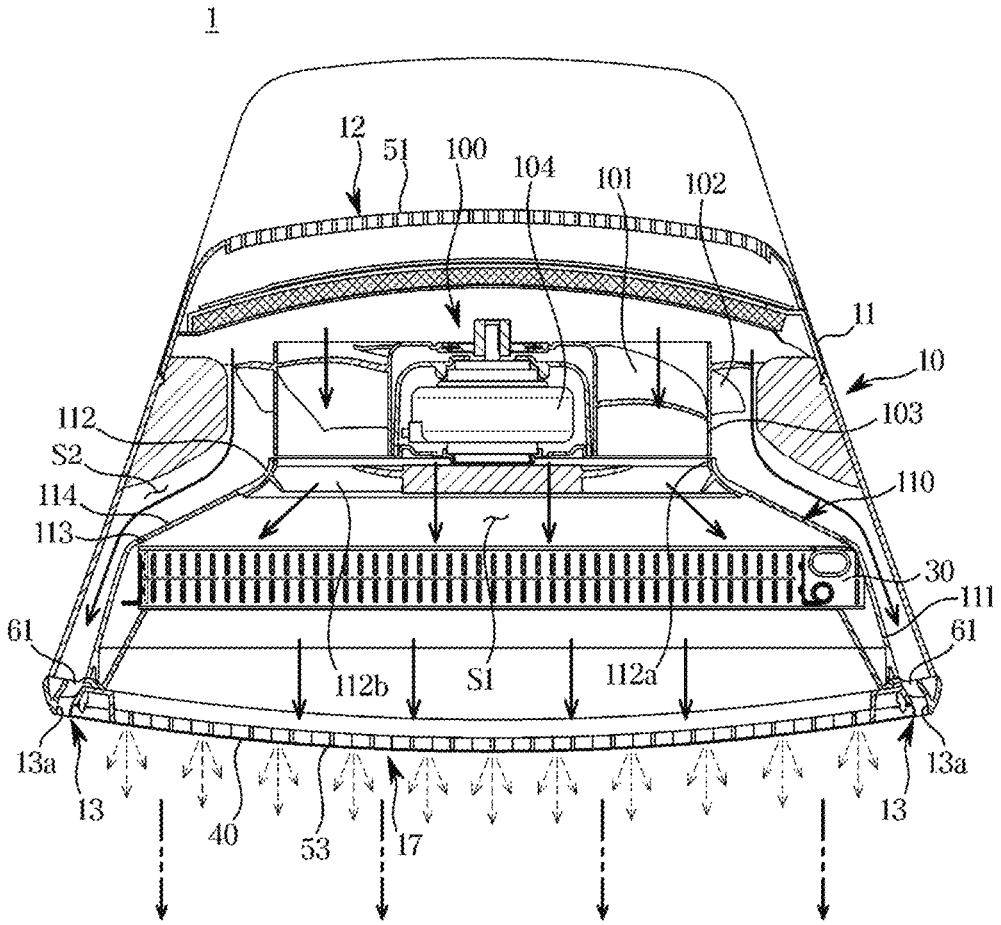
FIG. 3 is a cross-sectional view taken along line A-A' shown in FIG. 1, illustrating a state in which the air conditioner is operated in a first mode.
Figure 4:
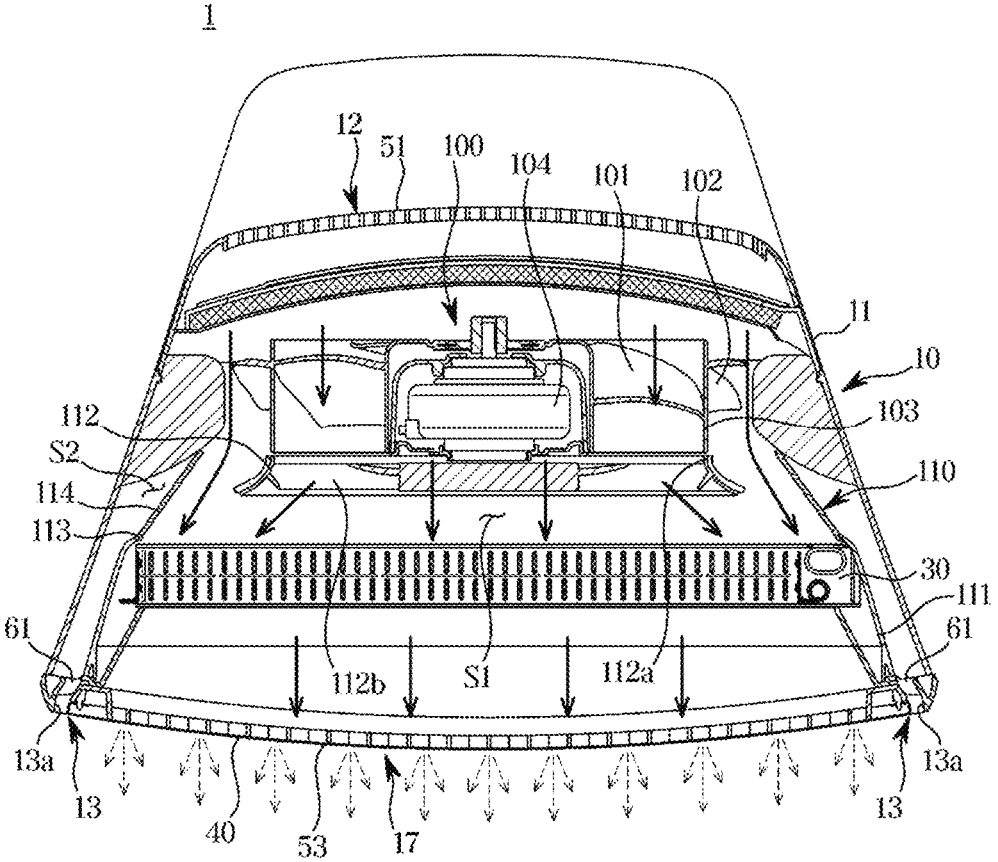
FIG. 4 is a view illustrating a state in which the air conditioner shown in FIG. 3 is operated in a second mode.

FIG. 1 is a view of an air conditioner according to one embodiment of the present disclosure. FIG. 2 is an exploded view of the air conditioner shown in FIG. 1. FIG. 3 is a cross-sectional view taken along line A-A' shown in FIG. 1, illustrating a state in which the air conditioner is operated in a first mode. FIG. 4 is a view illustrating a state in which the air conditioner shown in FIG. 3 is operated in a second mode.

Referring to FIGS. 1 to 4, an air conditioner 1 may include a housing 10 forming an exterior, a fan assembly 100 configured to circulate inside or outside air of the housing 10, and a heat exchanger 30 configured to exchange heat with air introduced into the inside of the housing 10.

The housing 10 may include a case 11 to which the fan assembly 100 and the heat exchanger 30 are mounted, and a front panel 16 provided to cover a front surface of the case 11. The housing 10 may include an inlet 12, a first outlet 17 and a second outlet 13.

The case 11 may form a rear surface, opposite side surfaces, an upper surface and a lower surface of the air conditioner 1. The front surface of the case 11 may be opened to form a case opening 11*a*, and the case opening 11*a* may be covered by the front panel 16.

The front panel 16 may be coupled to the case 11 to cover the case opening 11*a*. The front panel 16 may be coupled to the case opening 11*a*. FIG. 2 illustrates that the front panel 16 is separable from the case 11, but the front panel 16 and the case 11 may be integrally formed.

The first outlet 17 may be formed in the front panel 16. The first outlet 17 may be disposed on the front surface of the housing 10. The first outlet 17 may penetrate the front panel 16. The first outlet 17 may be formed in an upper portion of the front panel 16. The first outlet 17 may be disposed at a position substantially facing the inlet 12. Air that is heat-exchanged inside the housing 10 may be discharged to the outside of the housing 10 through the first outlet 17. The first outlet 17 may discharge air that is introduced through the inlet 12.

The inlet 12 may be formed in the case 11. The inlet 12 may penetrate the rear surface of the case 11. The inlet 12 may be formed in an upper portion of the rear surface of the case 11. Air may be introduced into the housing 10 through the inlet 12.

Although FIG. 2 illustrates that two inlets 12 are provided, the number of inlets 12 is not limited thereto, thus the number of the inlet may vary as needed. FIG. 2 illustrates that the inlet 12 is formed in a substantially rectangular shape, but the shape of the inlet 12 is not limited thereto. Therefore, the shape of the inlet may vary as needed.

The second outlet 13 may be formed on the front panel 16. The second outlet 13 may be formed on the left side and/or the right side of the first outlet 17. The second outlet 13 may be disposed adjacent to the first outlet 17. The second outlet 13 may be disposed spaced apart from the first outlet 17 by a predetermined distance.

The second outlet 13 may extend along a vertical direction of the case 11. The second outlet 13 may have a length approximately equal to a length of the first outlet 17. Air that is not heat-exchanged inside the housing 10 may be discharged to the outside of the housing 10 through the second outlet 13. The second outlet 13 may be provided to discharge air introduced through the inlet 12.

The second outlet 13 may be configured to mix air discharged from the second outlet 13 with the air discharged from the first outlet 17. Particularly, in a portion of the front panel 16, in which the second outlet 13 is formed, a guide curved portion 13*a* (refer to FIG. 3) provided to guide air, which is discharged from the second outlet 13, to allow the air, which is discharged from the second outlet 13, to be mixed with air, which is discharged from the first outlet 17, may be provided.

The air discharged through the second outlet 13 may be discharged along the guide curved portion 13*a* so as to be directed to a direction capable of being mixed with the air discharged from the first outlet 17. The guide curved portion 13*a* may guide the air discharged through the second outlet 13 to be discharged in approximately the same direction as the air discharged through the first outlet 17.

A blade 61 provided to guide the air discharged through the second outlet 13 may be provided on the second outlet 13. The blade 61 may be continuously disposed along a longitudinal direction of the second outlet 13.

An air flow path connecting the fan assembly 100 to the first outlet 17 is referred to as a first flow path S1, and an air flow path connecting the fan assembly 100 to the second outlet 13 is referred to as a second flow path S2. The first flow path S1 and the second flow path S2 may be partitioned from each other. Accordingly, air flowing through the first flow path S1 and air flowing through the second flow path S2 may not be mixed.

Particularly, the first flow path S1 and the second flow path S2 may be partitioned from each other by a partition member 110. The partition member 110 may be disposed inside the housing 10 in which the fan assembly 100 is disposed. The partition member 110 may be separable from the case 11. The fan assembly 100 may be installed on a rear surface of the partition member 110. The partition member 110 may include a partition plate 111, a stator 112, a hinge 113, and a flow path control unit 114.

The partition plate 111 may extend in the vertical direction. The partition plate 111 may extend along a direction in which the second outlet 13 is formed. The second flow path S2 may be formed in a space between the partition plate 111 and the case 11.

The stator 112 may be disposed at a rear end of the partition plate 111. The stator 112 may be disposed in front of the fan assembly 100. The stator 112 may be configured to distribute the air, which is discharged from the fan assembly 100, to the first flow path S1 and the second flow path S2. The stator 112 may be provided in accordance with a size and/or shape of a first fan 101.

The stator 112 may include a stator opening 112*a* provided to face the fan assembly 100. The stator opening 112*a* may be disposed to face the first fan 101 of the fan assembly 100. The stator opening 112*a* may be provided to communicate with a boundary portion 103. The stator opening 112*a* may be formed to have a diameter approximately equal to a diameter of the first fan 101. The diameter of the stator opening 112*a* may be provided to have a size of 0.8 to 1.2 times the diameter of the first fan 101. The stator opening 112*a* may be formed to have a diameter approximately equal to a diameter of the boundary portion 103. The diameter of the stator opening 112*a* may be provided to have a size of 0.8 to 1.2 times the diameter of the boundary portion 103.

Air discharged from the first fan 101 of the fan assembly 100 may be guided to the first flow path S1 through the stator opening 112*a*. The air discharged from the first fan 101 may be passed through the inside of the stator 112 and then guided to the first flow path S1. Air discharged from a second fan 102 disposed along an outer circumferential surface of the boundary portion 103 may be guided to the second flow path S2 along an outer surface of the stator 112. The stator 112 may guide the air, which is discharged from the first fan 101, to the first flow path S1, and may guide the air, which is discharged from the second fan 102, to the second flow path S2. The stator 112 may distribute the air, which is discharged from the fan assembly 100, to the first flow path S1 and the second flow path S2.

The stator 112 may include a stator guide 112*b*. The stator guide 112*b* may extend substantially along a radial direction of the stator 112. The stator guide 112*b* may be provided in plural. The stator guide 112*b* may guide air, which is passed through the stator opening 112*a*, to the first outlet 17.

The hinge 113 may be provided to rotatably support the flow path control unit 114. The hinge 113 may be disposed at one end of the flow path control unit 114. The hinge 113 may be installed at one end of the partition plate 111.

The flow path control unit 114 may be rotatable around the hinge 113 so as to open and close the second flow path S2. The flow path control unit 114 may extend along the vertical direction.

Particularly, referring to FIG. 3, in response to that the other end of the flow path control unit 114, which is opposite to the one end in which the hinge 113 is arranged, is in contact with the stator 112, the flow path control unit 114 may open the second flow path S2. Accordingly, the air conditioner 1 may discharge air, which is heat-exchanged, through the first outlet 17 and discharge the air, which is not heat-exchanged, through the second outlet 13. The air, which is discharged through the first outlet 17, and the air, which is discharged through the second outlet 13, are mixed and then discharged farther than the air discharged only through the first outlet 17. This operation may be referred to as that the air conditioner 1 is operated in a first mode.

Referring to FIG. 4, in response to that the other end of the flow path control unit 114, which is opposite to the one end in which the hinge 113 is arranged, is in contact with an inner surface of the case 11, the flow path control unit 114 may close the second flow path S2. Accordingly, the air conditioner 1 may discharge the heat-exchanged air only through the first outlet 17. The heat-exchanged air may be discharged at a low speed through the first outlet 17. This operation may be referred to as that the air conditioner 1 is operated in a second mode.

The air conditioner 1 according to one embodiment of the present disclosure may selectively open and close the second flow path S2 by the hinge 113 and the flow path control unit 114, thereby controlling air discharged through the second outlet 13.

The air conditioner 1 may allow air, which exchanges heat with the heat exchanger 30, to be discharged through the first outlet 17, and allow air, which is not passed through the heat exchanger 30, to be discharged through the second outlet 13. That is, the second outlet 13 may be provided to discharge air that is not heat-exchanged. Because the heat exchanger 30 is disposed on the first flow path S1, air discharged through the first outlet 17 may be heat-exchanged air. Because the heat exchanger is not disposed on the second flow path S2, the air discharged through the second outlet 13 may be the air that is not heat-exchanged.

The case 11 may have a shape in which a cross section along a horizontal direction increases toward a lower side. Due to this shape, the housing 10 may be stably supported against the floor.

An accommodation space 19, in which electronic components (not shown) are arranged, may be formed inside the case 11. Electronic components needed for driving the air conditioner 1 may be disposed in the accommodation space 19.

The fan assembly 100 may be disposed in a flow path between the inlet 12 and the first outlet 17. The fan assembly 100 may be disposed on the first flow path S1. Air may be introduced into the housing 10 through the inlet 12 by the fan assembly 100. Air introduced through the inlet 12 may be moved along the first flow path S1 and then discharged to the outside of the housing 10 through the first outlet 17. FIG. 2 illustrates that three fan assemblies 100 are provided, but is not limited thereto. Therefore, the number of the fan assembly may vary as needed.

The fan assembly 100 may include the first fan 101, the second fan 102, the boundary portion 103, and a fan driver 104.

The first fan 101 may be disposed on the inside with respect to the boundary portion 103. The first fan 101 may discharge air, which is introduced through the inlet 12, to the first flow path S1. The first fan 101 may discharge air, which is introduced through the inlet 12, to the inside of the stator 112. The first fan 101 may discharge air, which is introduced through the inlet 12, to the first outlet 17 through the stator opening 112*a*. The first fan 101 may discharge air, which is introduced through the inlet 12, to the heat exchanger 30 through the stator opening 112*a*.

The second fan 102 may be disposed on the outside with respect to the boundary portion 103. The second fan 102 may discharge air, which is introduced through the inlet 12, to the second flow path S2. The second fan 102 may discharge air, which is introduced through the inlet 12, to the outside of the stator 112. The second fan 102 may discharge air, which is introduced through the inlet 12, to the second outlet 13.

The boundary portion 103 may be disposed between the first fan 101 and the second fan 104. The boundary portion 103 may have a tubular shape in which opposite ends are open. The first fan 101 may be disposed on an inner circumferential surface of the boundary portion 103. The second fan 102 may be disposed on an outer circumferential surface of the boundary portion 103. The boundary portion 103 may allow the first flow path S1 and the second flow path S2 to be partitioned from each other.

A diameter of the boundary portion 103 may be approximately the same as the diameter of the stator opening 112*a* of the stator 112. The boundary portion 103 may be disposed to face the stator 112. The diameter of the boundary portion 103 may have a size of approximately 0.8 to 1.2 times the diameter of the stator opening 112*a*.

The fan driver 104 may drive the first fan 101 and the second fan 102. The first fan 101 and the second fan 102 may be rotated by a single fan driver 104. The fan driver 104 may be disposed approximately at the center of the first fan 101. The fan driver 104 may include a motor.

The fan driver 104 may be connected to the first fan 101. The fan driver 104 may rotate the boundary portion 103 connected to the first fan 101 by rotating the first fan 101, and rotate the second fan 102 by rotating the boundary portion 103.

The fan driver 104 may be connected to the boundary portion 103. The fan driver 104 may rotate the first fan 101 and the second fan 102 connected to the boundary portion 103 by rotating the boundary portion 103.

Because the fan assembly 100 according to one embodiment of the present disclosure includes the first fan 101 and the second fan 102 rotated by the single fan driver 104, it is possible to discharge the air to the first flow path S1 and the second flow path S2 by using the single fan assembly 100.

The heat exchanger 30 may be disposed between the fan assembly 100 and the first outlet 17. The heat exchanger 30 may be disposed on the first flow path S1. Alternatively, the heat exchanger 30 may be disposed between the inlet 12 and the fan assembly 100.

The heat exchanger 30 may absorb heat from air introduced through the inlet 12 or transfer heat to the air introduced through the inlet 12. The heat exchanger 30 may include a tube and a header coupled to the tube. However, the type of the heat exchanger 30 is not limited thereto.

The air conditioner 1 may include a discharge panel 40 disposed on a portion of the front panel 16 in which the first outlet 17 is formed. The discharge panel 40 may include a plurality of discharge holes provided to allow the air, which is discharged from the first outlet 17, to be discharged more slowly than the air discharged from the second outlet 13. The plurality of discharge holes may penetrate the discharge panel 40. The plurality of discharge holes may be formed in a fine size. The plurality of discharge holes may be uniformly distributed throughout an area of the discharge panel 40. The heat-exchanged air discharged through the first outlet 17 may be uniformly discharged at a low speed by the plurality of discharge holes.

The air conditioner 1 may include an inlet grill 51 coupled to a portion of the case 11 in which the inlet 12 is formed. The inlet grill 51 may be provided to prevent foreign substances from flowing through the inlet 12. For this, the inlet grill 51 may include a plurality of slits or holes. The inlet grill 51 may be provided to cover the inlet 12.

The air conditioner 1 may include a discharge grill 53 coupled to a portion of the front panel 16 in which the first outlet 17 is formed. The discharge grill 53 may be provided to prevent foreign substances from discharging through the first outlet 17. For this, the discharge grill 53 may include a plurality of slits or holes. The discharge grill 53 may be provided to cover the first outlet 17.

Figure 5:
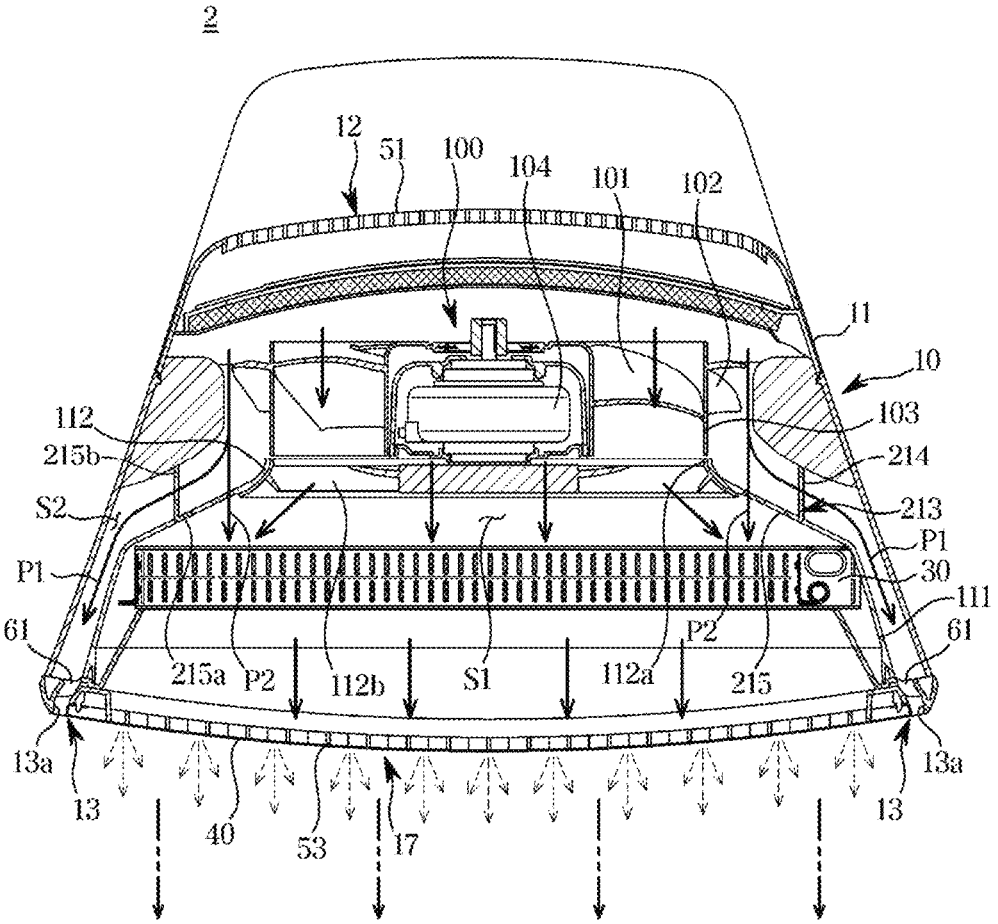
FIG. 5 is a cross-sectional view of an air conditioner according to another embodiment of the present disclosure.
Figure 6:
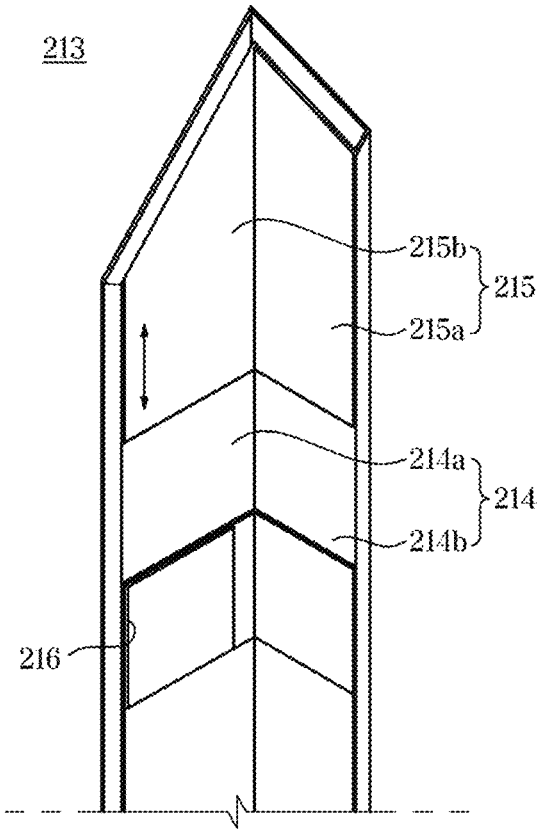
FIG. 6 is a view illustrating a state in which a flow path control unit shown in FIG. 5 opens a first discharge flow path.
Figure 7:
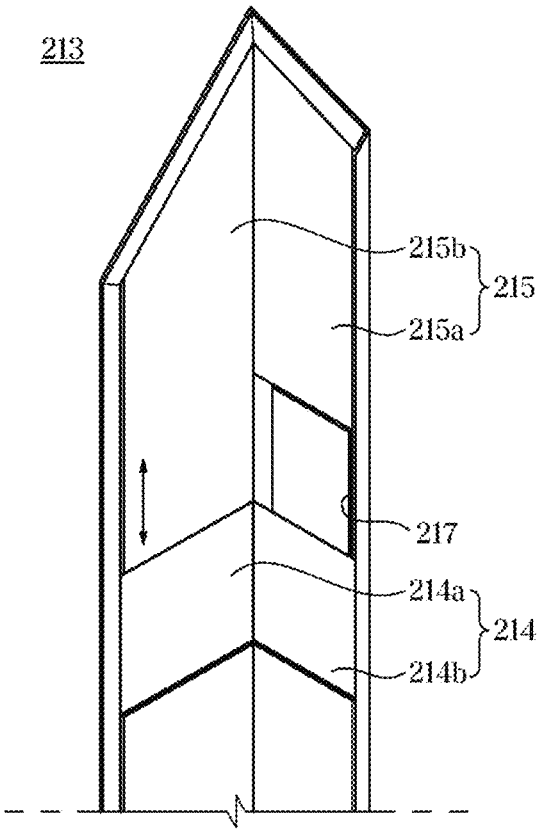
FIG. 7 is a view illustrating a state in which the flow path control unit shown in FIG. 5 opens a second discharge flow path.

FIG. 5 is a cross-sectional view of an air conditioner according to another embodiment of the present disclosure. FIG. 6 is a view illustrating a state in which a flow path control unit shown in FIG. 5 opens a first discharge flow path. FIG. 7 is a view illustrating a state in which the flow path control unit shown in FIG. 5 opens a second discharge flow path Hereinafter configurations similar to the above description use the same reference numerals, and descriptions thereof may be omitted.

Referring to FIGS. 5 to 7, a flow control unit 213 of an air conditioner 2 may include a sliding member 214 and a fixing member 215.

The fixing member 215 may include a first fixing portion 215*a* extending in the same direction as a direction in which the partition plate 111 of the partition member 110 extends, and a second fixing portion 215*b* disposed on the second flow path S2. The second fixing portion 215*b* may be formed to be bent from the first fixing portion 215*a*. The fixing member 215 may extend in a vertical direction in which the plurality of fan assemblies 100 extends.

A first opening 217 provided to penetrate the first fixing portion 215*a* may be formed in the first fixing portion 215*a*. The first opening 217 may be provided to guide the air, which is discharged from the second fan 102, to the first flow path S1. The first opening 217 may be provided in plural along a direction in which the first fixing portion 215*a* extends. The first opening 217 may communicate with the first flow path S1.

A second opening 216 provided to penetrate the second fixing portion 215*b* may be formed in the second fixing portion 215*b*. The second opening 216 may be provided to guide the air, which is discharged from the second fan 102, to the second flow path S2. The second opening 216 may be provided in plural along a direction in which the second fixing portion 215*b* extends. The second opening 216 may communicate with the second flow path S2.

The sliding member 214 may be slidably coupled to the fixing member 215. The sliding member 214 may include a first sliding portion 214*a* sliding on the first fixing portion 215*a* and a second sliding portion 214*b* sliding on the second fixing portion 215*b*.

Particularly, referring to FIGS. 5 and 6, in order to discharge air through both of the first outlet 17 and the second outlet 13, the air conditioner 2 may move the sliding member 214 to a position configured to open the second opening 216. In response to the sliding member 214 being moved to the position configured to open the second opening 216, the first sliding portion 214*a* of the sliding member 214 may be in a position configured to close the first opening 217. Accordingly, the air discharged from the second fan 102 may be not moved to the first flow path S1, but may be passed through the second flow path S2 and then discharged through the second outlet 13. (direction P1) The non-heat-exchanged air discharged through the second outlet 13 may be discharged to a relatively distant location together with the heat-exchanged air discharged through the first outlet 17.

Referring to FIGS. 5 and 7, in order to discharge the air only through the first outlet 17, the air conditioner 2 may move the sliding member 214 to a position configured to open the first opening 217. In response to the sliding member 214 being moved to the position configured to open the first opening 217, the second sliding portion 214*b* of the sliding member 214 may be in a position configured to close the second opening 216. Accordingly, the air discharged from the second fan 102 may be not moved to the second flow path S2, but passed through the first flow path S1 and heat-exchanged and then discharged through the first outlet 17. (direction P2) That is, the air discharged from the second fan 102 may be heat-exchanged together with the air discharged from the first fan 101 and then discharged to the first outlet 17.

Figure 8:
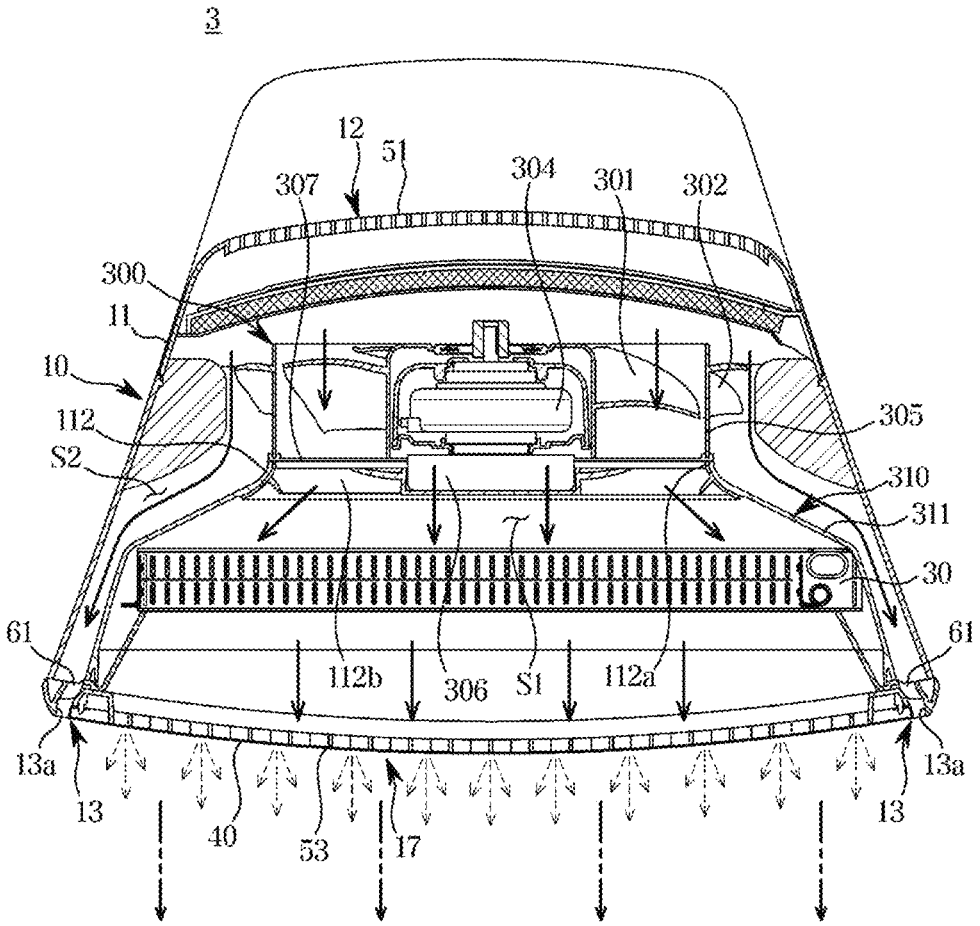
FIG. 8 is a view illustrating another embodiment of a fan assembly shown in FIG. 3.

FIG. 8 is a view illustrating another embodiment of a fan assembly shown in FIG. 3.

Hereinafter configurations similar to the above description use the same reference numerals, and descriptions thereof may be omitted.

Referring to FIG. 8, a fan assembly 300 of an air conditioner 3 may include a first fan 301, a second fan 302, a first fan driver 304, and a second fan driver 306. The first fan 301 and the second fan 302 may be driven independently of each other.

The first fan 301 may be rotated by receiving power from the first fan driver 304. The first fan 301 may be disposed inside the second fan 302. The first fan 301 may discharge air, which is introduced from the inlet 12, to the first flow path S1. The first fan 301 may discharge air, which is introduced from the inlet 12, to the inside of the stator 112.

The second fan 302 may be rotated by receiving power from the second fan driver 306. The second fan 302 may be disposed on the outside of the first fan 301. The second fan 302 may discharge air, which is introduced from the inlet 12, to the second flow path S2. The second fan 302 may discharge air, which is introduced from the inlet 12, to the outside of the stator 112.

The second fan 302 may extend outward from a fan body 305 provided in a tubular shape on the outside of the first fan 301. The fan body 305 may be connected to the second fan driver 306 through a power transmitter 307. The power generated from the second fan driver 306 may be transmitted to the fan body 305 through the power transmitter 307, and the second fan 302 may be rotated in response to the rotation of the fan body 305.

Due to this configuration, the first fan 301 and the second fan 302 may be driven independently of each other, and the air conditioner 3 may discharge air through the first outlet 17 and/or the second outlet 13.

Figure 9:
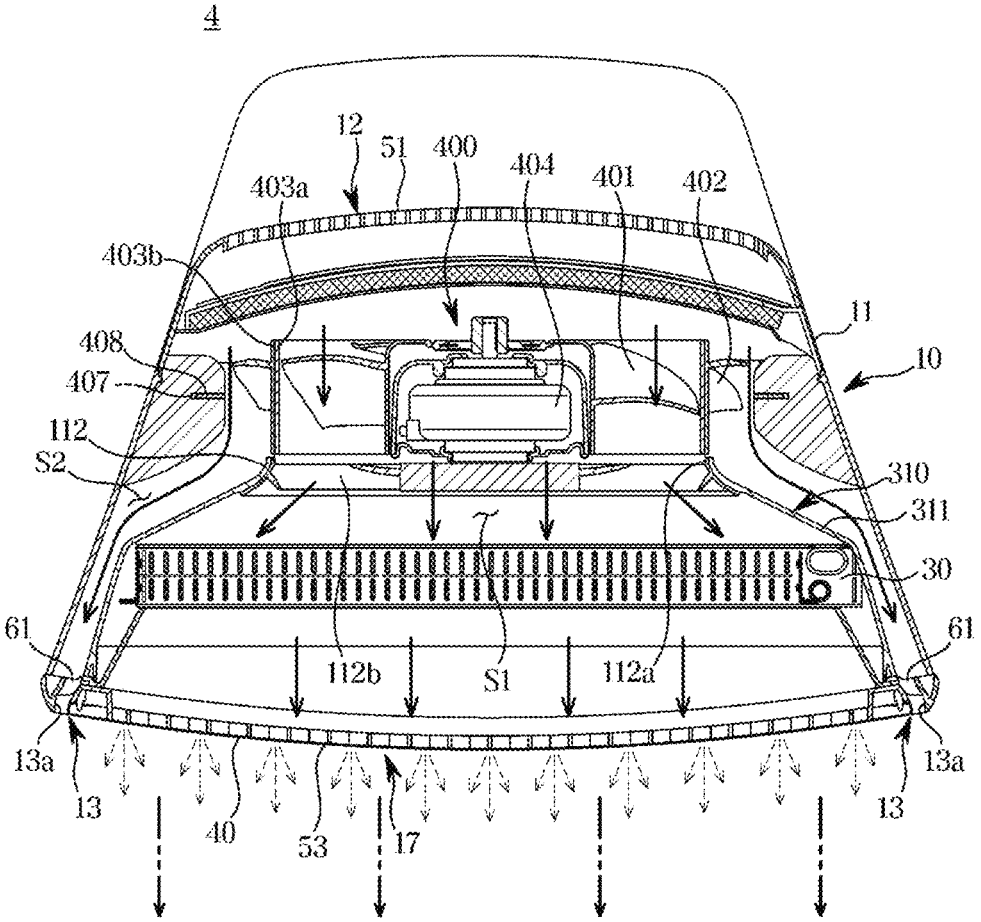
FIG. 9 is a view illustrating a state in which the air conditioner according to another embodiment to the present disclosure is operated in a first mode.
Figure 10:
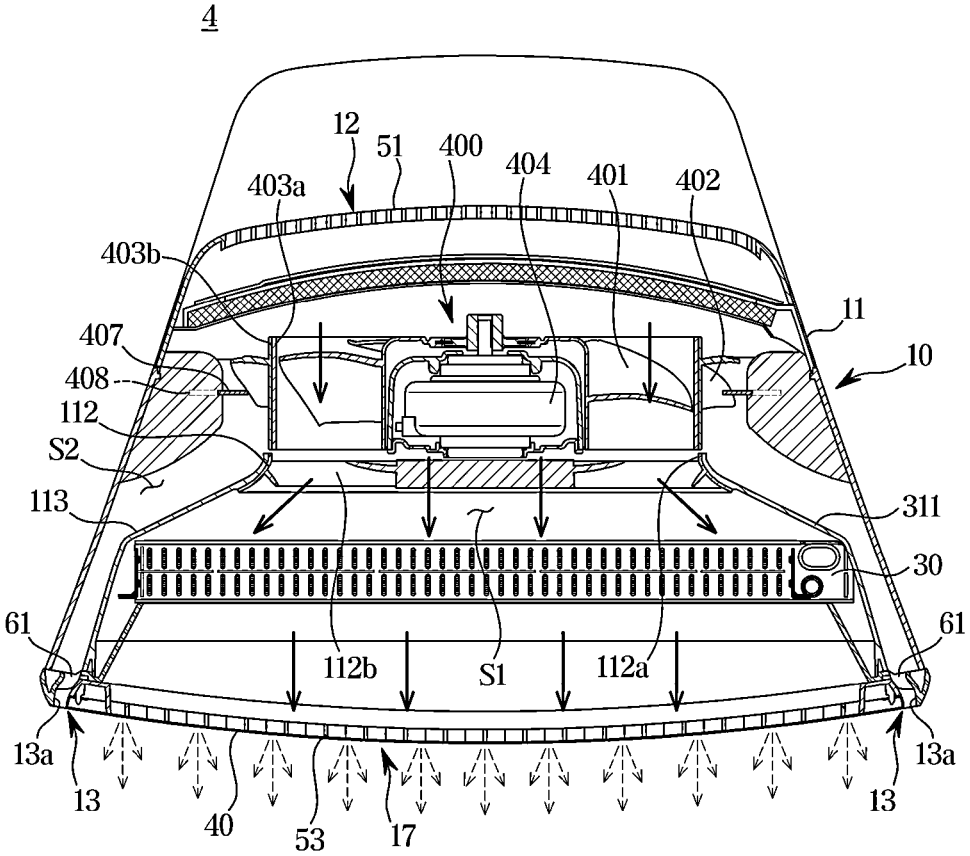
FIG. 10 is a view illustrating a state in which the air conditioner shown in FIG. 9 is operated in a second mode.

FIG. 9 is a view illustrating a state in which the air conditioner according to another embodiment to the present disclosure is operated in a first mode. FIG. 10 is a view illustrating a state in which the air conditioner shown in FIG. 9 is operated in a second mode.

Hereinafter configurations similar to the above description use the same reference numerals, and descriptions thereof may be omitted.

Referring to FIGS. 9 and 10, an air conditioner 4 may include a fan assembly 400, and a fan control member 407.

The fan assembly 400 may include a first fan 401, a second fan 402, a first boundary portion 403*a*, a second boundary portion 403*b*, and a fan driver 404.

The first fan 401 may be rotated by receiving power from the fan driver 404. The first fan 401 may be connected to the first boundary portion 403*a* and rotated together with the first boundary portion 403*a*. The first boundary portion 403*a* may have a tubular shape. The first fan 401 and the first boundary portion 403*a* may be rotated together by the power generated from the fan driver 404.

The second fan 402 may be rotated together with the first fan 401 or the second fan 402 may maintain a stopped state in response to the rotation of the first fan 401. The second fan 402 may be connected to the second boundary portion 403*b*. The second fan 402 may extend outward from the second boundary portion 403*b*. The second boundary portion 403*b* may have a tubular shape. The first boundary portion 403*a* may be inserted into an inside of the second boundary portion 403*b*. An outer circumferential surface of the first boundary portion 403*a* may be in contact with an inner circumferential surface the second boundary portion 403*b*.

The second boundary portion 403*b* may be in contact with the first boundary portion 403*a*. The second boundary portion 403*b* may be rotated together with the first boundary portion 403*a* or may be provided to slip with respect to the first boundary portion 403*a*.

The fan control member 407 may be provided to be insertable into a member insertion groove 408 formed in the case 11. The fan control member 407 may be inserted into the member insertion groove 408 as shown in FIG. 9, and may be drawn out from the member insertion groove 408 to protrude from an inner wall of the case 11, as shown in FIG. 10. The air conditioner 4 may include a driving means (not shown) configured to move the fan control member 407.

Particularly, referring to FIG. 9, the air conditioner 4 operated in the first mode may insert the fan control member 407 into the inside of the member insertion groove 408 so as to rotate the second fan 402, thereby discharging air to the second flow path S2. As the fan driver 404 rotates the first fan 401 and the first boundary portion 403*a*, the second boundary portion 403*b* in contact with the first boundary portion 403*a* may be rotated. As the second boundary portion 403*b* is rotated, the second fan 402 may be rotated. A portion of the air introduced into the inlet 12 may be discharged to the first outlet 13 through the second flow path S2 by the rotation of the second fan 402.

Referring to FIG. 10, the air conditioner 4 operated in the second mode may withdraw the fan control member 407 from the member insertion groove 408 so as to prevent the rotation of the second fan 402, thereby preventing the air from being discharged to the second flow path S2. Accordingly, the fan control member 407 may be located in a position configured to limit the rotation of the second fan 402. Therefore, even when the fan driver 404 rotates the first fan 401 and the first boundary portion 403*a*, the fan control member 407 may interfere with the rotation of the second fan 402. Accordingly, the second fan 402 and the second boundary portion 403*b* may not be rotated. The air introduced into the inlet 12 may be passed through the first flow path S1 by the rotation of the first fan 401 and heat-exchanged and then discharged only through the first outlet 17.

Figure 11:
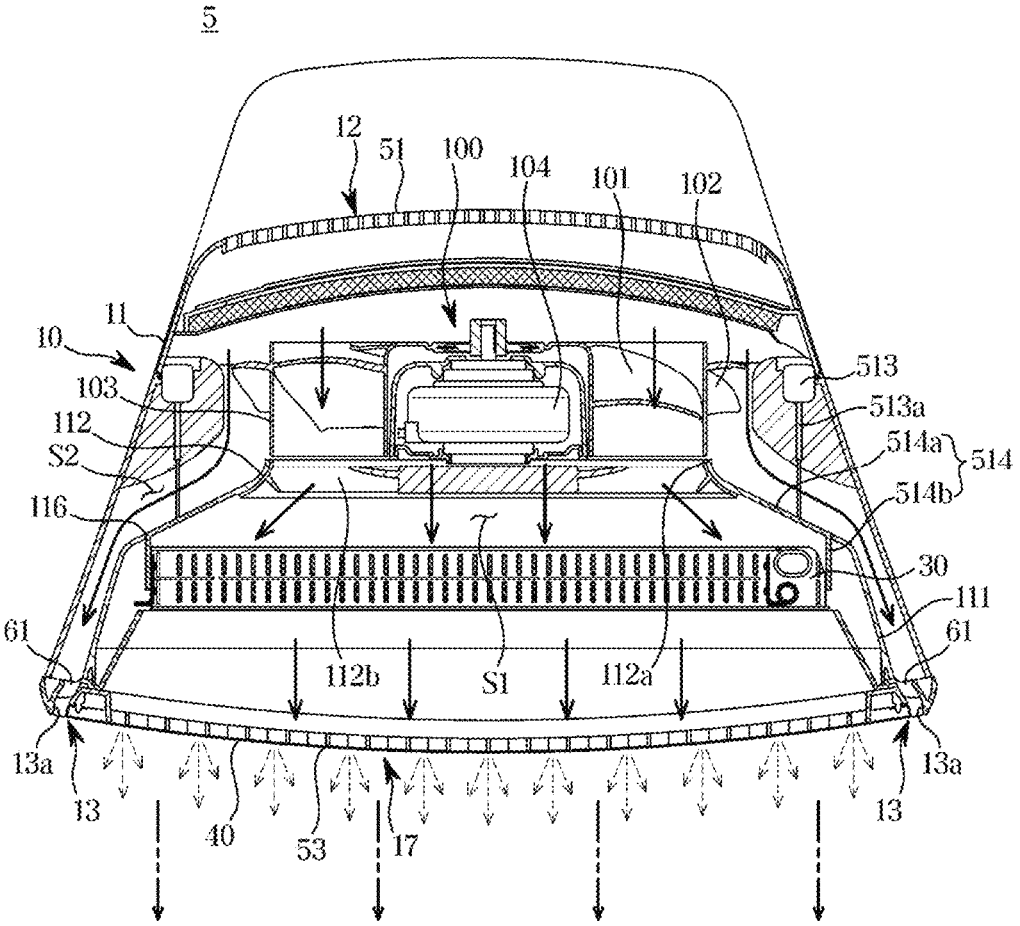
FIG. 11 is a view illustrating a state in which an air conditioner according to still another embodiment to the present disclosure is operated in a first mode.
Figure 12:
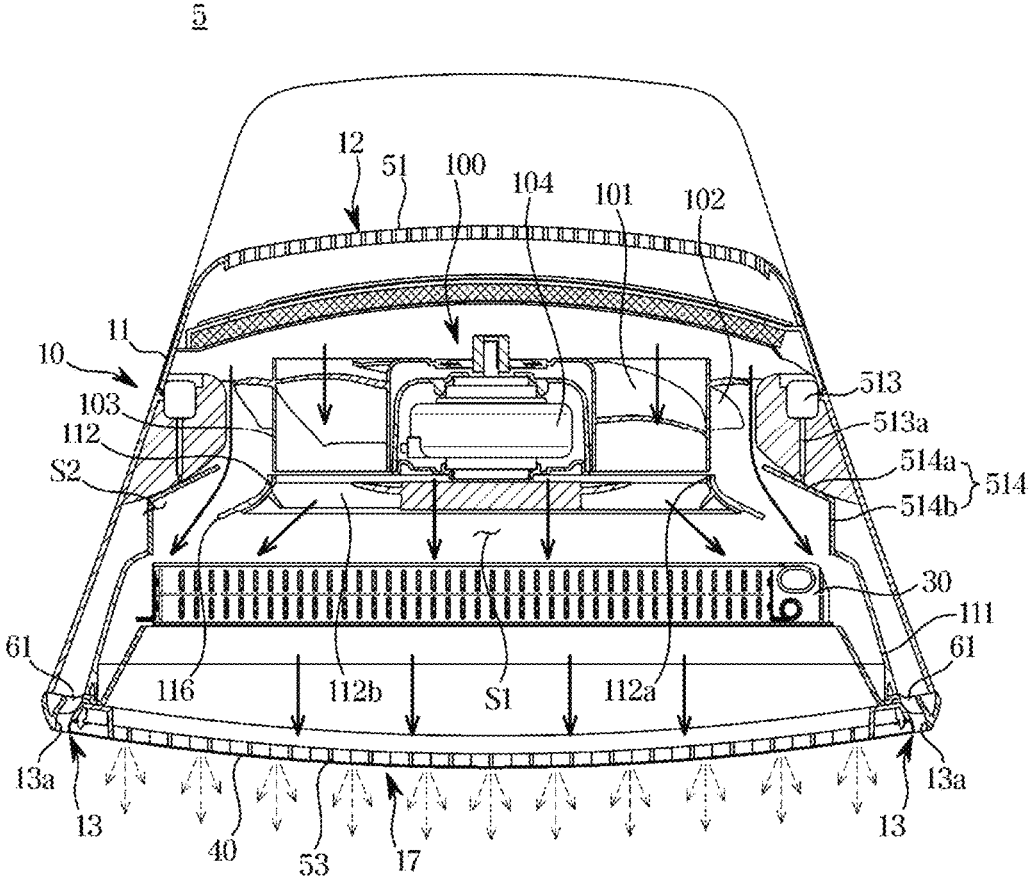
FIG. 12 is a view illustrating a state in which the air conditioner shown in FIG. 11 is operated in a second mode.

FIG. 11 is a view illustrating a state in which an air conditioner according to still another embodiment to the present disclosure is operated in a first mode. FIG. 12 is a view illustrating a state in which the air conditioner shown in FIG. 11 is operated in a second mode Hereinafter configurations similar to the above description use the same reference numerals, and descriptions thereof may be omitted.

An air conditioner 5 may include a driving source 513, a power transmission member 513*a*, and a flow path control unit 514 which are to selectively open and close the second flow path S2.

The driving source 513 may be provided inside the case 11 and may generate power for moving the flow path control unit 514. The power transmission member 513*a* may transmit power generated by the driving source 513 to the flow path control unit 514.

The flow path control unit 514 may be moved along a front and rear direction by the power transmitted from the power transmission member 513*a*. The flow path control unit 514 may include a first portion 514*a* and a second portion 514*b*. The flow path control unit 514 may extend along the vertical direction in which the second flow path S2 is formed.

The first portion 514*a* may be formed to be bent from the second portion 514*b*. The first portion 514*a* may be provided to allow the first flow path S1 and the second flow path S2 to be partitioned from each other in response to the first mode of the air conditioner 5.

The second portion 514*b* may be provided to block the second flow path S2 in response to the second mode of the air conditioner 5.

Particularly, referring to FIG. 11, the air conditioner 5 operated in the first mode may move the flow path control member 514 forward to allow the first portion 514*a* to define the first flow path S1 and the second flow path S2. The first portion 514*a* may be inserted into a partition opening 116 formed in the partition member 110. The first portion 514*a* may extend from the partition plate 111 to the stator 112. Accordingly, air discharged by the second air fan 102 may be moved along the second flow path S2 and then discharged through the second outlet 13.

Referring to FIG. 12, the air conditioner 5 operated in the second mode may move the flow path control member 514 rearward to allow the second portion 514*b* to block the second flow path S2. The second portion 514*b* may extend from one end of the partition opening 116 to the inner wall of the case 11. Accordingly, the air discharged from the second fan 102 may not be moved to the second flow path S2, but moved to the first flow path S1 and heat-exchanged and then discharged through the first outlet 17.

Figure 13:
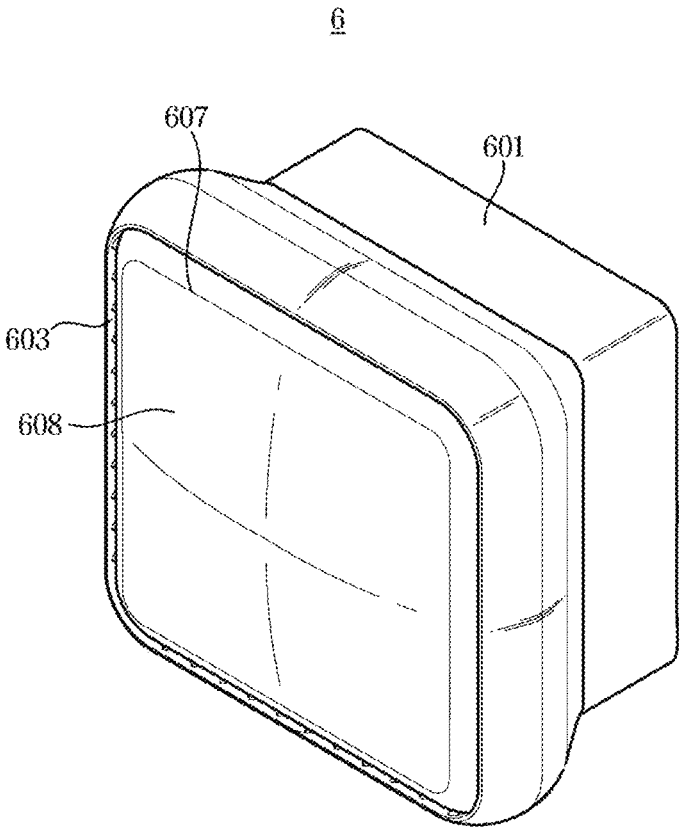
FIG. 13 is a view illustrating an air purifier according to one embodiment of the present disclosure
Figure 14:
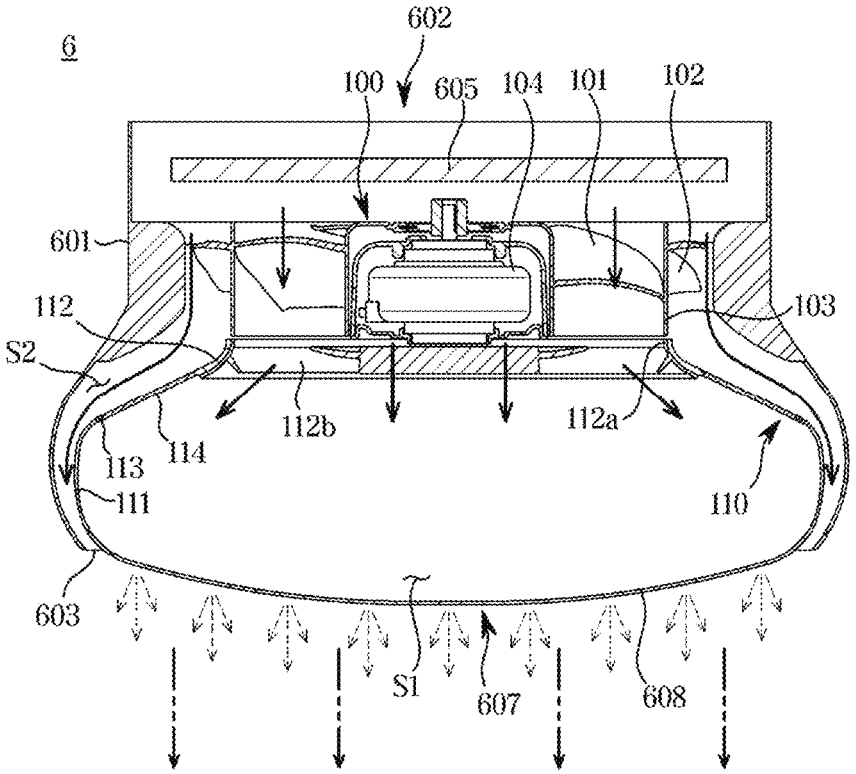
FIG. 14 is a cross-sectional view of the air purifier shown in FIG. 13.

FIG. 13 is a view illustrating an air purifier according to one embodiment of the present disclosure. FIG. 14 is a cross-sectional view of the air purifier shown in FIG. 13.

Hereinafter configurations similar to the above description use the same reference numerals, and descriptions thereof may be omitted.

Referring to FIGS. 13 and 14, the fan assembly 100 shown in FIGS. 3 and 4 may be applicable to an air purifier that is an example of home appliance.

An air purifier 6 may include a housing 601 forming an exterior. A first outlet 607 and a second outlet 603 may be formed on a front surface of the housing 601. The second outlet 603 may be disposed on the outside along an edge of the first outlet 607. A discharge panel 608 may be disposed in the first outlet 607. The discharge panel 608 may include a plurality of discharge holes having a fine size.

An inlet 602 may be formed on a rear surface of the housing 601. Air may be introduced into the housing 601 through the inlet 602 and discharged to the outside of the housing 601 through the first outlet 607 and/or the second outlet 603.

A filter 605 may be disposed inside the housing 601. The filter 605 may be disposed between inlet 602 and the fan assembly 100. The filter 605 may filter out foreign substances in the air introduced through the inlet 602. Alternatively, the filter 605 may be disposed between the fan assembly 100 and the first outlet 607.

The air passed through the filter 605 may be discharged to the first outlet 607 or the second outlet 603 by the fan assembly 100.

The air discharged by the first fan 101 may be discharged into the stator opening 112*a* of the stator 112. The air discharged into the stator opening 112*a* may be passed through the first flow path S1 and discharged to the first outlet 607. The air discharged through the first outlet 607 may be discharged at a low speed by the plurality of discharge holes having a fine size formed in the discharge panel 608. The air purifier 6 may reduce noise caused by the discharged air.

The air discharged by the second fan 102 may be discharged to the outside of the stator 112. The air discharged by the second fan 102 may be passed through the second flow path S2 and discharged to the second outlet 603. The air discharged through the second outlet 603 may be discharged farther forward together with the air discharged through the first outlet 607.

The air conditioner 6 may include a hinge 113 and a flow path control unit 114. The flow path control unit 114 may be rotated by the hinge 113 and configured to open and close the second flow path S2. Accordingly, in order to discharge air only through the first outlet 607, the air conditioner 6 may rotate the flow path control unit 114 to a position configured to block the second flow path S2.

Figure 15:
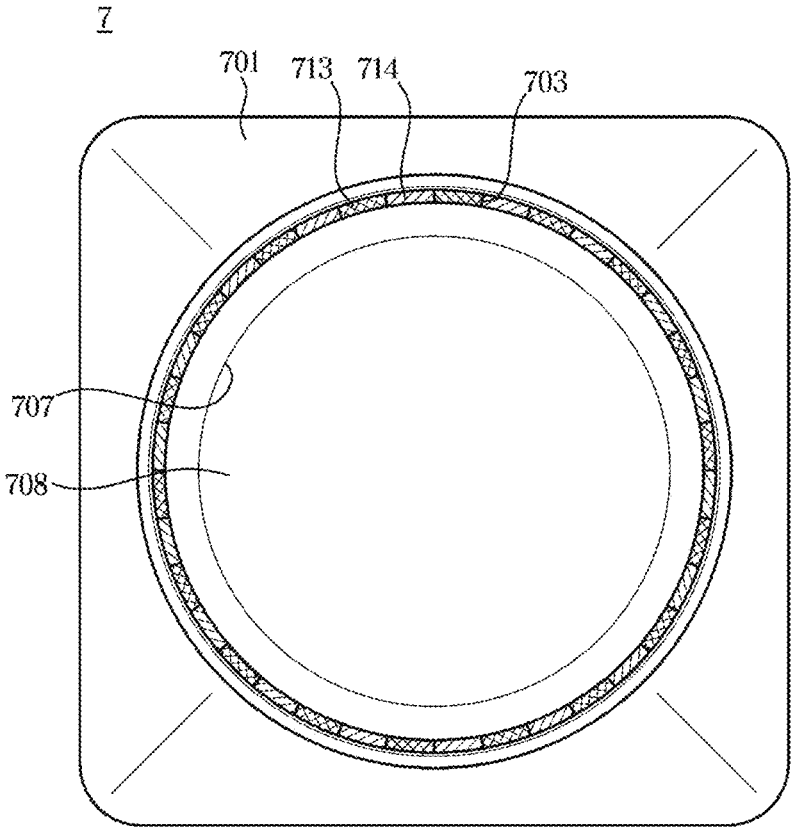
FIG. 15 is a view illustrating a state in which an air purifier according to another embodiment to the present disclosure is operated in a first mode.
Figure 16:
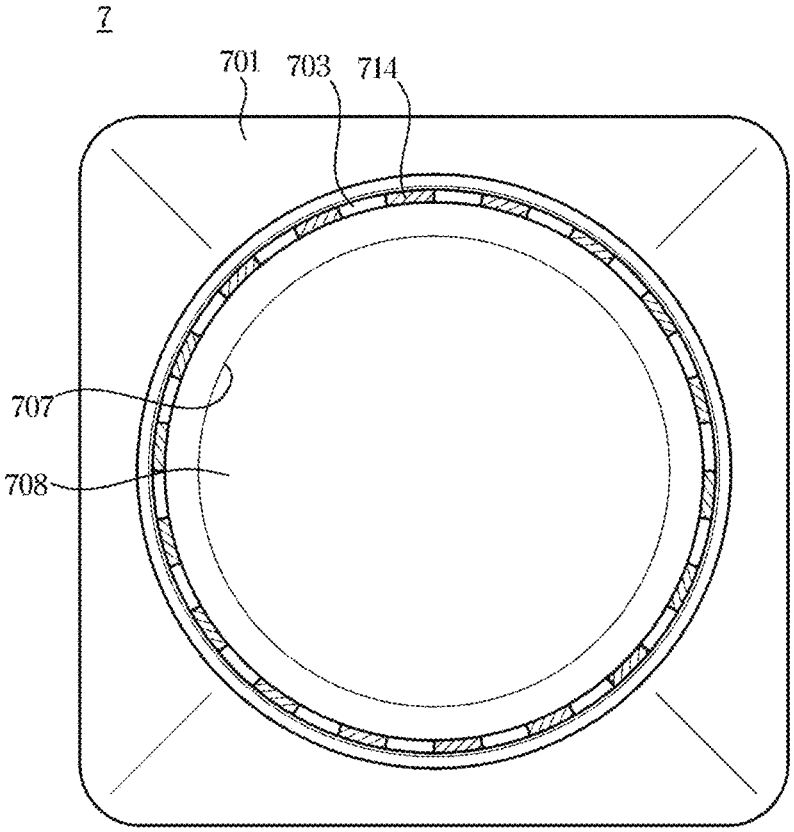
FIG. 16 is a view illustrating a state in which the air purifier shown in FIG. 15 is operated in a second mode.

FIG. 15 is a view illustrating a state in which an air purifier according to another embodiment to the present disclosure is operated in a first mode. FIG. 16 is a view illustrating a state in which the air purifier shown in FIG. 15 is operated in a second mode.

Hereinafter configurations similar to the above description use the same reference numerals, and descriptions thereof may be omitted.

Referring to FIGS. 15 and 16, an air purifier 7 may include a housing 701 forming an exterior. A first outlet 707 and a second outlet 703 may be formed on a front surface of the housing 701. The second outlet 703 may be formed outside the first outlet 707 along an outer circumference of the first outlet 707.

A discharge panel 708 may be disposed in the first outlet 707. The discharge panel 708 may include a plurality of discharge holes having a fine size.

A second plate 713 and a first plate 714 may be disposed in the second outlet 703. The first plate 714 may be fixed to the housing 701. The second plate 713 may be configured to be rotatable with respect to the second plate 713.

Particularly, referring to FIG. 15, in order to discharge air only through the first outlet 707, the air purifier 7 operated in the first mode may move the second plate 713 to close the second outlet 703. Accordingly, the air purifier 7 may discharge the filtered air at a low speed.

Referring to FIG. 16, in order to discharge air not only through the first outlet 707 but also through the second outlet 703, the air purifier 7 operated in the second mode may rotate the second plate 713 with respect to the first plate 714 to open the second outlet 703. Accordingly, the air purifier 7 may discharge the filtered air farther than in the first mode.

While the present disclosure has been particularly described with reference to exemplary embodiments, it should be understood by those of skilled in the art that various changes in form and details may be made without departing from the spirit and scope of the present disclosure.

The invention claimed is:

1. An air conditioner comprising:

a housing comprising an inlet;

a first outlet formed in the housing to discharge air introduced through the inlet;

a second outlet disposed adjacent to the first outlet;

a fan assembly comprising a first fan configured to discharge air toward the first outlet, and a second fan configured to discharge air toward the second outlet;

a first flow path formed between the first fan and the first outlet in the housing;

a second flow path partitioned from the first flow path and formed between the second fan and the second outlet in the housing;

a stator provided to guide air, which is discharged from the first fan, to the first outlet, and provided to guide air, which is discharged from the second fan, to the second outlet;

a heat exchanger disposed on the first flow path and configured to exchange heat with air discharged from the first fan and directed to the first outlet;

a flow control unit configured to selectively block the second flow path; and a partition plate provided to allow the first flow path and the second flow path to be partitioned from each other, wherein the flow control unit is rotatably coupled to the partition plate.

2. The air conditioner of claim 1, further comprising:

a fixing panel comprising a first opening provided to communicate with the first flow path and a second opening provided to communicate with the second flow path; and a sliding panel slidably coupled to the fixing panel and configured to open and close the first opening and the second opening.

3. The air conditioner of claim 1, further comprising:

an actuator configured to generate power for moving the flow control unit; and a power transmission member configured to transmit the power generated from the actuator to the flow control unit.

4. The air conditioner of claim 1, wherein the fan assembly comprises a fan driver configured to drive the first fan and the second fan.

5. The air conditioner of claim 1, further comprising:

a fan control member configured to selectively interfere with a rotation of the second fan, wherein the first fan and the second fan are configured to be rotatable independently of each other, and wherein the fan assembly comprises a fan driver configured to rotate the first fan.

6. The air conditioner of claim 1, wherein:

the fan assembly comprises a first fan driver configured to drive the first fan; and a second fan driver configured to drive the second fan, and the first fan is provided to have the same rotation axis as the second fan, and the first fan is arranged inside the second fan.

7. The air conditioner of claim 1, wherein:

the fan assembly comprises a boundary portion disposed between the first fan and the second fan, and the boundary portion is disposed to face the stator.

8. The air conditioner of claim 7, wherein:

the stator comprises a stator opening provided to communicate with the boundary portion, and a diameter of the stator opening is the same as a diameter of the boundary portion.

9. A home appliance comprising:

a housing comprising an inlet;

a first outlet formed in the housing to discharge air introduced through the inlet;

a second outlet disposed adjacent an outer circumference to the first outlet;

a fan assembly comprising a first fan configured to discharge air toward the first outlet, and a second fan configured to discharge air toward the second outlet;

a stator provided to guide air, which is discharged from the first fan, to the first outlet;

a first plate fixed to the housing and disposed in the second outlet; and a second plate configured to be rotatable about an outer circumference of the first plate, and configured to selectively open and close the second outlet.

10. The home appliance of claim 9, further comprising:

a filter arranged between the inlet and the fan assembly.

11. The home appliance of claim 9, further comprising:

a heat exchanger arranged between the first fan and the first outlet.

* * * * *